US009831053B2

(12) United States Patent
Haehnel et al.

(10) Patent No.: US 9,831,053 B2
(45) Date of Patent: Nov. 28, 2017

(54) ARRANGEMENT FOR AN ELECTRICAL SWITCH ELEMENT AND SWITCH ELEMENT

(71) Applicant: TE Connectivity Germany GmbH, Bensheim (DE)

(72) Inventors: Thomas Haehnel, Berlin (DE); Albert Koetter, Berlin (DE); Christian Maranke, Luechfeld (DE); Rene Wagner, Berlin (DE); Titus Ziegler, Berlin (DE)

(73) Assignee: TE Connectivity Germany GmbH, Bensheim (DE)

( * ) Notice: Subject to any disclaimer, the term of this patent is extended or adjusted under 35 U.S.C. 154(b) by 0 days.

(21) Appl. No.: 14/944,781

(22) Filed: Nov. 18, 2015

(65) Prior Publication Data

US 2016/0071670 A1 Mar. 10, 2016

Related U.S. Application Data

(63) Continuation of application No. PCT/EP2014/061055, filed on May 28, 2014.

(30) Foreign Application Priority Data

May 31, 2013 (DE) ..... 10 2013 210 195

(51) Int. Cl.
*H01H 33/18* (2006.01)
*H01H 50/54* (2006.01)
(Continued)

(52) U.S. Cl.
CPC ..... *H01H 33/182* (2013.01); *H01H 33/72* (2013.01); *H01H 50/546* (2013.01);
(Continued)

(58) Field of Classification Search
CPC ..... H01H 1/20; H01H 9/44; H01H 9/443; H01H 33/182; H01H 33/72; H01H 50/02; H01H 50/546; H01H 9/04
(Continued)

(56) References Cited

U.S. PATENT DOCUMENTS 2,913,557 A * 11/1959 Immel ..... H01H 9/443 218/26
3,560,901 A * 2/1971 Shizuka ..... H01H 50/02 335/132
(Continued)

FOREIGN PATENT DOCUMENTS

DE 10 2012 005 031 A1 1/2013
EP 0372554 A2 6/1990
(Continued)

OTHER PUBLICATIONS

Abstract of DE 102012005031(A1), dated Jan. 10, 2013, 1 page.
(Continued)

*Primary Examiner* — Renee Luebke
*Assistant Examiner* — William Bolton
(74) *Attorney, Agent, or Firm* — Barley Snyder

(57) ABSTRACT

An electrical contact switch chamber is disclosed. The electrical contact switch chamber includes two contacts, a wall having a base and sides surrounding the two contacts, and at least one insulation slot having an opening extending transversely relative to a direction between the contacts. The at least one insulation slot is disposed along a portion of the wall between the two contacts.

14 Claims, 7 Drawing Sheets

(51) Int. Cl.

| | |
|---|---|
| ***H01H 33/72*** | (2006.01) |
| ***H01H 1/20*** | (2006.01) |
| ***H01H 9/44*** | (2006.01) |
| ***H01H 50/02*** | (2006.01) |

(52) U.S. Cl.
CPC ..... *H01H 1/20* (2013.01); *H01H 9/443* (2013.01); *H01H 2050/028* (2013.01)

(58) Field of Classification Search
USPC ..... 218/22–26; 335/201, 202
See application file for complete search history.

(56) References Cited

U.S. PATENT DOCUMENTS

| | | | | |
|---|---|---|---|---|
| 5,546,061 | A * | 8/1996 | Okabayashi | H01H 9/443 335/78 |
| 8,093,974 | B2 * | 1/2012 | Nagura | H01H 9/047 335/201 |
| 8,198,964 | B2 | 6/2012 | Yoshihara et al. | |
| 2010/0207713 | A1 * | 8/2010 | Sugisawa | H01H 50/54 335/192 |
| 2011/0221548 | A1 * | 9/2011 | Yoshihara | H01H 51/29 335/185 |
| 2012/0234624 | A1 | 9/2012 | Takeuchi et al. | |
| 2014/0028418 | A1 * | 1/2014 | Yamashita | H01H 9/40 335/201 |

FOREIGN PATENT DOCUMENTS

| | | |
|---|---|---|
| EP | 2466608 A2 | 12/2011 |
| EP | 2551882 A1 | 1/2013 |

OTHER PUBLICATIONS

PCT International Search Report, International Application No. PCT/EP2014/061055, dated Jul. 31, 2014, 4 pages.
English translation of Chinese First Office Action, dated Nov. 18, 2016, 8 pages.
Chinese First Office Action, dated Nov. 18, 2016, 6 pages.

* cited by examiner

ARRANGEMENT FOR AN ELECTRICAL SWITCH ELEMENT AND SWITCH ELEMENT

CROSS-REFERENCE TO RELATED APPLICATIONS

This application is a continuation of PCT International Application No. PCT/EP2014/061055, filed May 28, 2014, which claims priority to German Application No. 10 2013 210 195.3, filed May 31, 2013.

FIELD OF THE INVENTION

The invention relates to an arrangement for an electrical switch element, and more particularly, to an electrical switch element for switching high currents.

BACKGROUND

Known electrical switch elements include a contact switch chamber and two contacts which are arranged in the contact switch chamber. Switch elements which are constructed in this manner are, for example, used in electric and hybrid motor vehicles in order to switch the high currents which occur therein.

The two contacts are electrically connected to each other by means of a movable bridging element. When the connection is separated, due to the high currents and field strengths, an electric arc occurs between a contact and the bridging element. The electric arc can burn combustible plastics materials in the chamber into carbon black. This carbon black accumulates in the chamber and, owing to its electrical conductivity, can lead to short-circuits and creep currents between the two contacts.

SUMMARY

An object of the invention, among others, is to provide an electrical switch element in which the risk of short-circuits and the occurrence of creep currents between the contacts are reduced. The disclosed electrical contact switch chamber includes two contacts, a wall having a base and sides surrounding the two contacts; and at least one insulation slot having an opening extending transversely relative to a direction between the contacts. The at least one insulation slot is disposed along a portion of the wall between the two contacts.

BRIEF DESCRIPTION OF THE DRAWINGS

The invention will now be described by way of example with reference to the accompanying figures, of which.

DETAILED DESCRIPTION OF THE EMBODIMENT(S)

The invention is explained in greater detail with reference to embodiments of an electrical switch element. This invention may, however, be embodied in many different forms and should not be construed as limited to the embodiments set forth herein; rather, these embodiments are provided so that this disclosure will be thorough and complete and still fully convey the scope of the invention to those skilled in the art.

Figure 1:
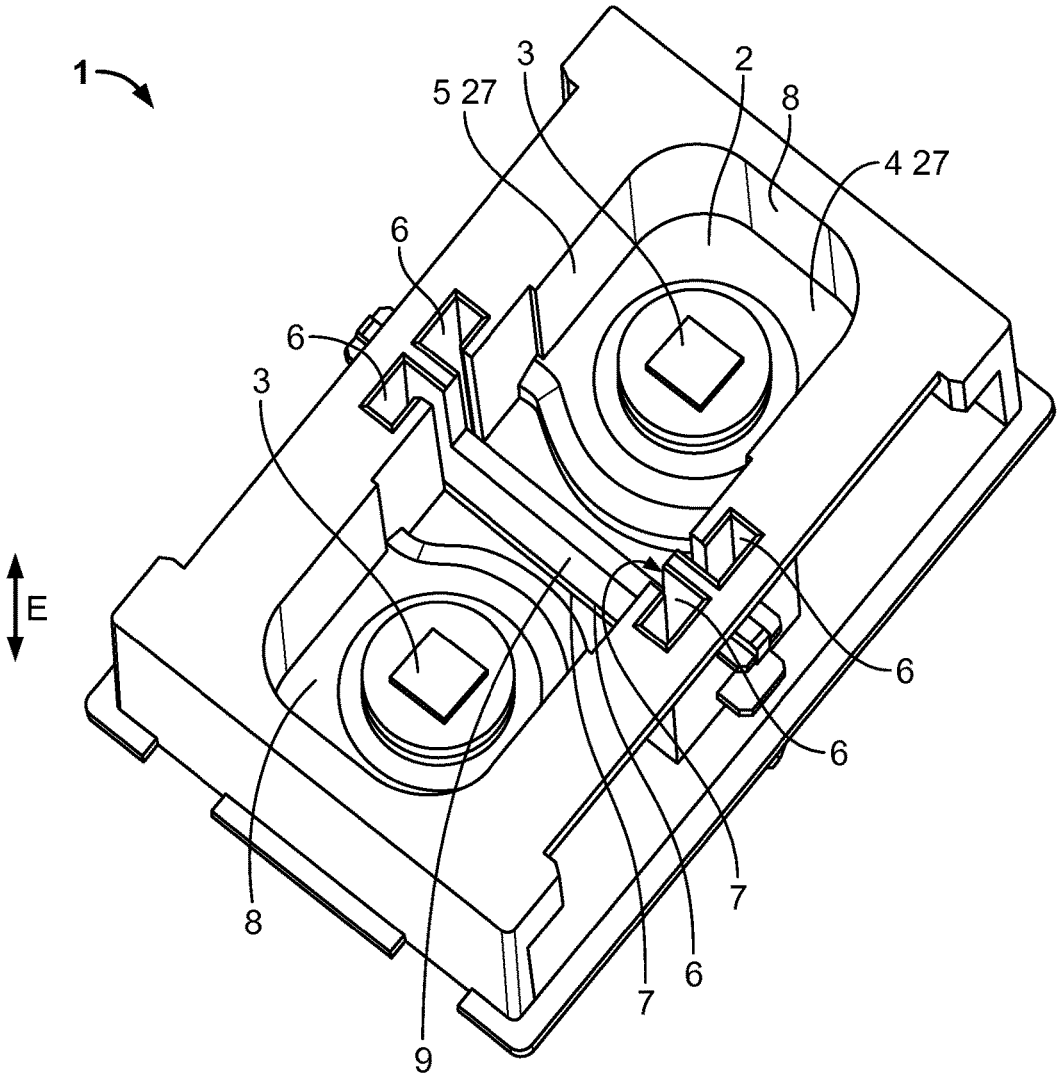
FIG. 1 is a perspective view of an electrical switch element according to the invention.
Figure 2:
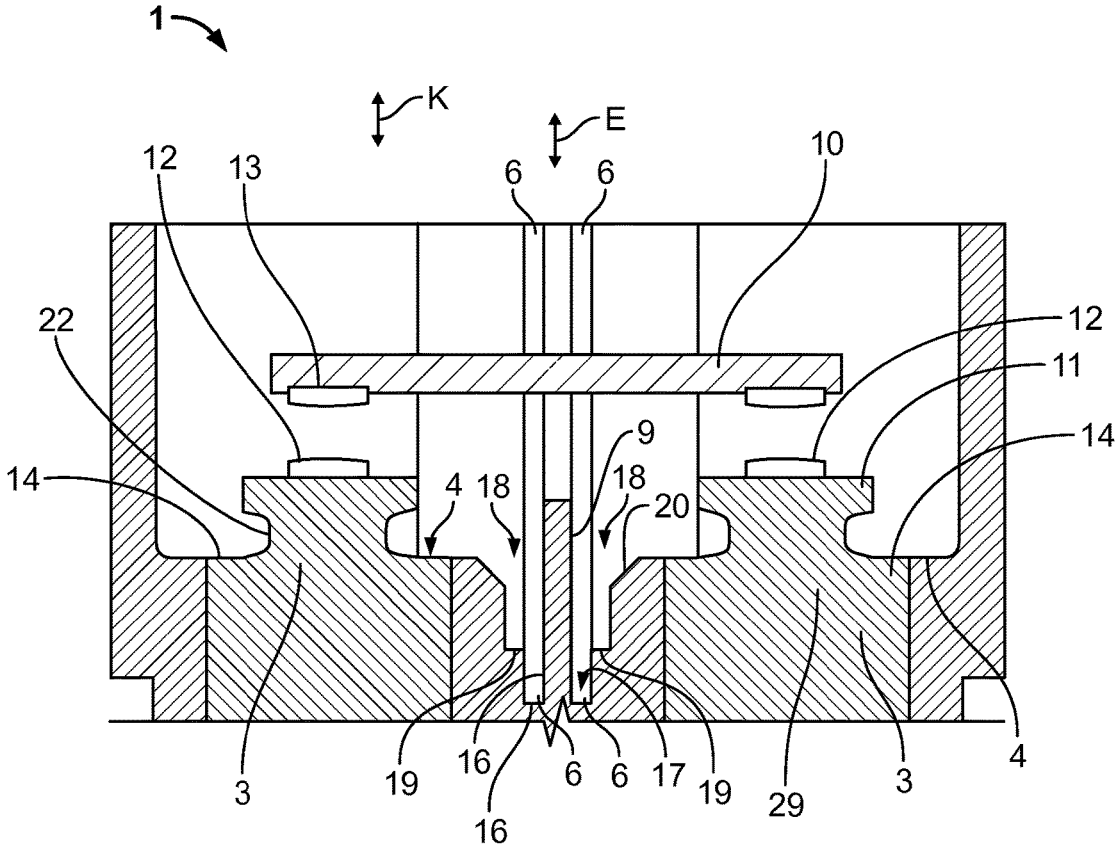
FIG. 2 is a sectional side view of the electrical switch element of FIG. 1.

FIGS. 1 and 2 show an electrical switch element 1 according to the present invention. The electrical switch element 1 includes a contact switch chamber 2 and a bridging element 10. The major components of the invention will now be described in greater detail.

The contact switch chamber 2, as shown in FIG. 1, has two contacts 3 which are arranged in the contact switch chamber 2. The contact switch chamber 2 shown comprises for the most part plastics material, and may be formed as an injection-moulded component. The materials of the contact switch chamber 2 may contain additives. Electrically conductive elements, such as the contacts 3, are cast with the plastics material.

A base 4 and sides 5 of the contact switch chamber 2 each constitute a wall 27 surrounding the contacts 3. Between the two contacts 3 and along the wall 27, two insulation slots 6 have an opening 7 which extends transversely relative to a direction between the two contacts 3.

The contact switch chamber 2 is sub-divided into two part-chambers 8 by the partition wall 9, which extends away from the base 4 and protrudes into the contact switch chamber 2. The partition wall 9 does not extend as far from the base 4 as the sides 5. The part-chambers 8 each contain a contact 3, are connected to each other, and each have an insulation slot 6.

The insulation slots 6 merge directly into the partition wall 9, that is to say, a wall of the insulation slot 6 also forms a part of the partition wall 9. The insulation slots 6 extend between the two contacts 3 along a direction of the walls 27; along the base 4 and the sides 5 and parallel to a direction between the contacts 3, and are continuous on the base 4, at the sides 5 and therebetween. The insulation slots 6 have in the region of the base 4 a substantially U-shaped cross-section.

The insulation slots 6 have in the sides 5 a different cross-section from that at the base 4. At the sides 5, the insulation slot 6 expands behind the opening 7. In this region there is therefore a hollow space which has a larger cross-section than in the region of the opening 7. The length of the inner wall is thereby increased, particularly in the regions which face away from the opening 7. In the example embodiment shown, the insulation slot 6 extends at the side 5 parallel with an extraction direction E in which the contact switch chamber 2 is extracted from the mould after the injection-moulding operation. Production is thereby simple.

Figure 3:
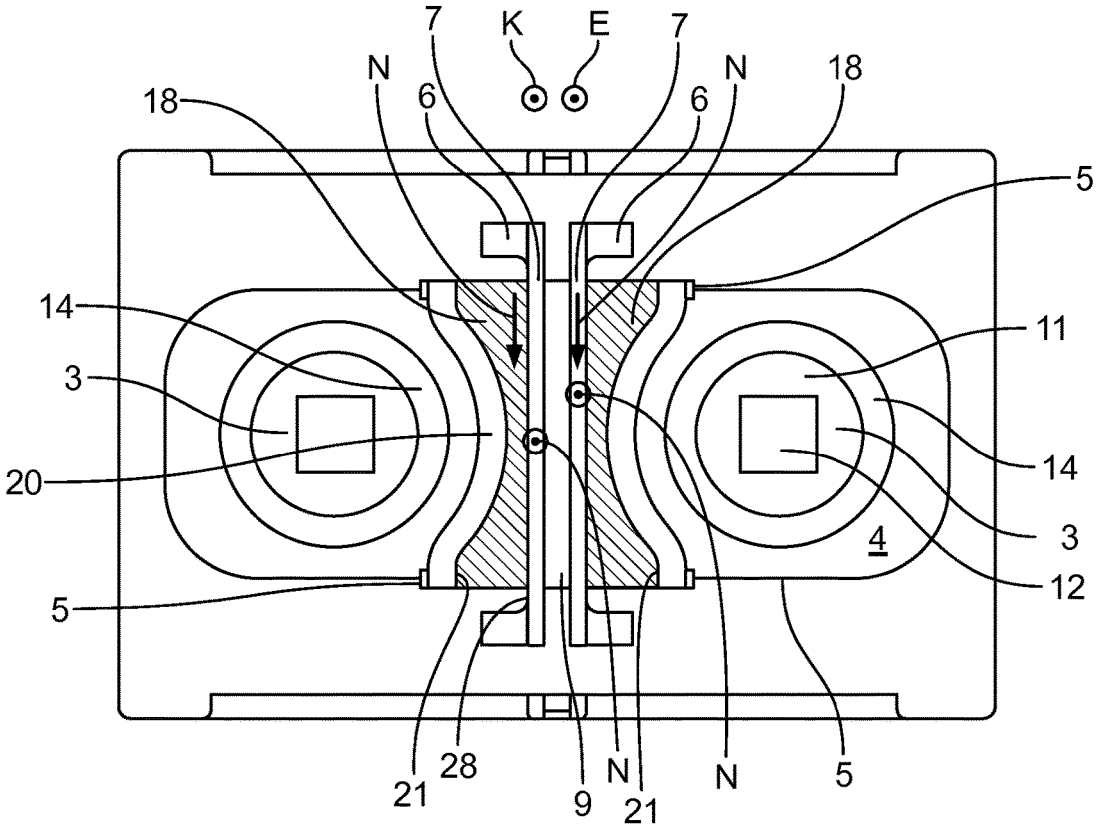
FIG. 3 is a plan view of the electrical switch element of FIG. 1.

The normal directions N of the openings 7 of the insulation slot 6, shown in FIG. 3, extend perpendicularly relative to a direction between the two contacts 3. The normal directions N in the region of the sides 5 are substantially parallel with the base 4 and perpendicular relative to the contact direction K and the extraction direction E. In the region of the base 4, the normal directions N are parallel with the contact direction K and the extraction direction E.

FIG. 2 shows the insulation slots 6 each delimited by two inner walls 16 and a base 17. These each extend in a planar manner. In an alternative embodiment, the inner walls 16 and in particular the base 17 may also be constructed so as not to be planar. Furthermore, in particular the base 17 may not be at right angles with respect to the inner walls 16, but could, for example, extend in an oblique manner. The insulation slots 6 may be produced with an injection-moulding method, in which the contact switch chamber 2 is extracted from a corresponding mould in an extraction direction E.

As also shown in FIG. 2, the contacts 3 include contact plates 11, and contact pieces 12 are fitted to the contact plates 11. The contact pieces 12 comprise a material which does not have a tendency to weld. The contacts 3 also each have a base 14 which is constructed so as to be wider relative to the contact plate 11. Between the contact plate 11 and the widened base 14 is a contraction 22. The bases 14 may act as a seal, and may be produced with an injection-moulding method in which the plastics components are injected around the bases 14. As an alternative to the described production using an injection-moulding method, the contacts 3 may also be pressed in the plastics material or screwed to it. Other fixing possibilities are also conceivable.

Two collection troughs 18 are each arranged beside an insulation slot 6 and merge via a step 19 directly therein. The collection troughs 18 are each located between a contact 3 and an insulation slot 6. The insulation slots 6 are therefore located when viewed from the contact 3 behind the collection troughs 18 and are shaded by them. The collection troughs 18 each have a chamfer 20 located at a side closer to the contact 3. As shown in FIG. 3, the collection troughs 18 each extend partially around the contacts 3. At the centre, the inner walls 21 of the collection troughs 18, on a side closer to the contacts 3, extend with uniform spacing around the contacts 3. The opening 7, as shown in FIG. 3, forms a tapered neck portion 28 which can extend into the insulation slot 6 to a greater or lesser extent.

Figure 4:
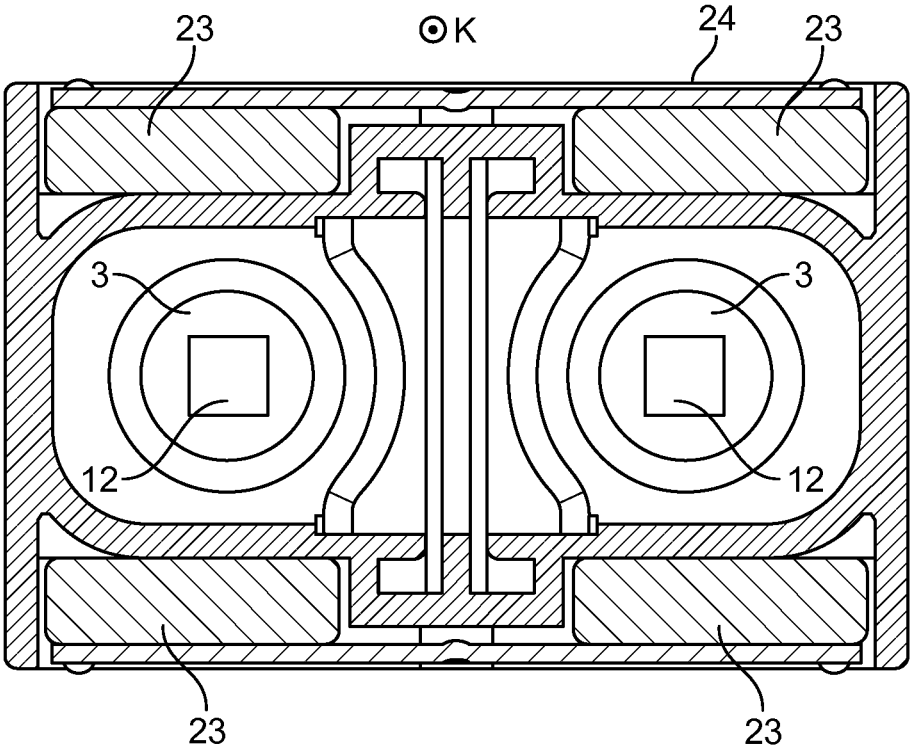
FIG. 4 is a sectional plan view of the electrical switch element of FIG. 1.
Figure 5:
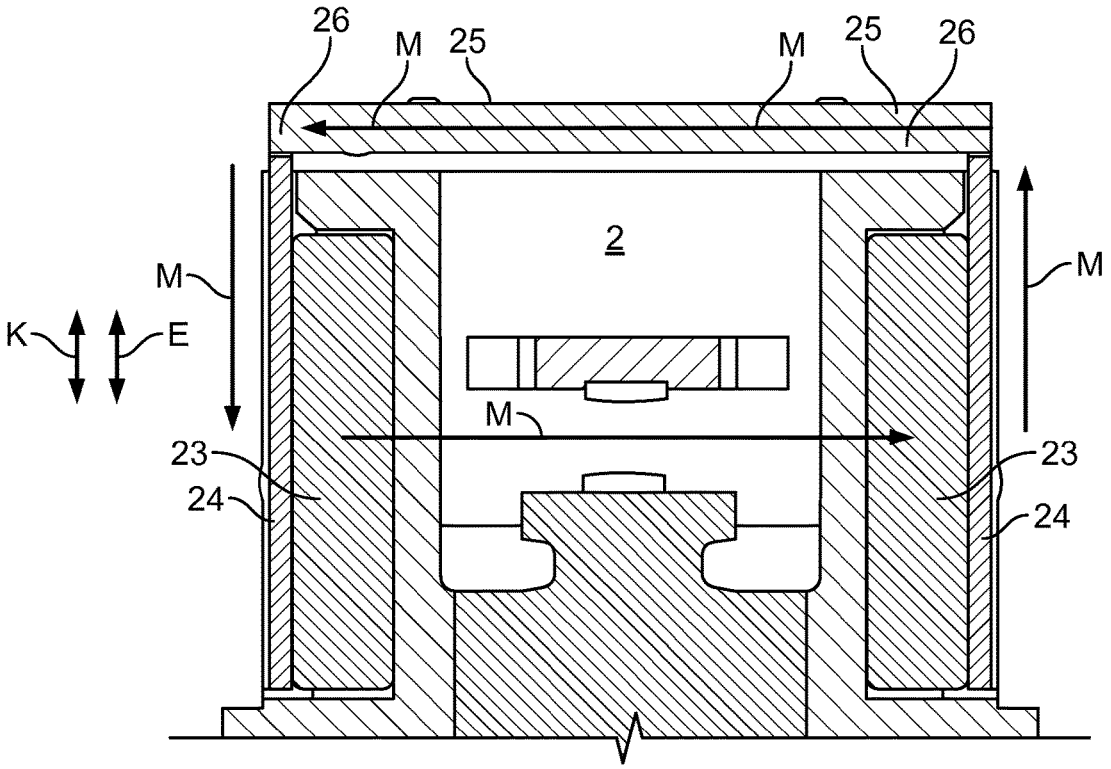
FIG. 5 is a sectional side view of an electrical switch element according to the invention.

There are arranged laterally beside the contacts 3 blow magnets 23, as shown in FIG. 4, which face each other in pairs with respect to a contact 3. Two blow magnets 23 which are arranged at a side 5 are connected to the side by means of a flux-conducting metal sheet 24, shown in FIGS. 4 and 5. FIG. 5 shows that the blow magnets 23 are further connected to each other at the upper side by means of an additional flux-conducting metal sheet 25. The upper flux-conducting metal sheet 25 is positioned accordingly with respect to the two horizontal upper edges 26 of the flux-conducting metal sheets 24 to magnetically connect the upper flux-conducting metal sheet 25 to the lateral flux-conducting metal sheets 24. This enables simple assembly. In order to prevent over-determination in terms of tolerances, the upper flux-conducting metal sheet 25 is positioned with a small gap dimension with respect to the horizontal upper edges 26.

The bridging element 10 is shown in FIG. 2. Contact counter-pieces 13 are arranged on the bridging element 10.

The operation of the electrical switch element 1 will now be described.

In order to produce an electrical connection between the two contacts 3, the bridging element 10 is moved in the contact direction K, shown in FIG. 2, onto and away from the contacts 3. This can be carried out by means of a drive. When the connection between the contacts 3 and the bridging element 10 is separated there is produced in the intermediate spaces an electric arc which acts on the plastics material of the contact switch chamber 2 and burns it to form carbon black. When the electric arc separates, there is produced in the contact switch chamber 2 a pressure wave which distributes the carbon black in the chamber.

There may be incorporated in the materials forming the contact switch chamber 2 materials hard gases which are converted into the gaseous state by the heat of the electric arc and thereby increase the pressure in the contact switch chamber 2. A spatial expansion of the electric arc is thereby limited.

The two insulation slots 6 and opening 7 prevent the carbon-containing carbon black from leading to an electrical connection between the two contacts 3. Owing to the narrow opening 7, the pressure wave which is produced when the electric arc separates cannot be introduced into deeper regions of the insulation slot 6. As the neck portion 28 becomes longer, a pressure wave in the hollow space located therebehind can be increasingly damped. Furthermore, the edges of the opening 7 shade the deeper regions so that no carbon black is accumulated in the deeper regions. In the deeper regions of the insulation slot 6, therefore, an electrical connection between the two contacts 3 which is produced by the carbon black is interrupted. Short-circuits and creep currents between the two contacts 3 are thereby prevented.

The partition wall 9 further increases the creep path between the two contacts 3, which further increases the insulation effect. The partition wall 9 is only of half-height in order not to limit movability of the bridging element 10. It also does not protrude from the sides 5 into the contact switch chamber 2, also in order not to limit movability of the bridging element. Furthermore, the carbon black accumulates increasingly on the base, whereby a partition wall 9 is particularly advantageous in this instance.

The insulation slots 6 achieve a peripheral insulation effect since the substantially U-shaped path of the insulation slots 6 separates the two contacts 3 from each other. In an upward direction, no insulation slot 6 is required since there is arranged in this region the bridging element 10 which shades the region located above it. The insulation effect of the insulation slot 6 is again improved due to the cross-section at the sides 5. A shading effect is also thereby improved.

The two collection troughs 18 serve to collect the carbon black in a selective manner and to keep it away in particular from the insulation slots 6. Due to the collection troughs 18, it is thereby possible for the electric arc always to have substantially the same spacing from the contact 3 when it separates.

The camfers 20 reduce the development of carbon black since a chamfer or a rounded portion is more difficult for the electric arc to burn to carbon black than a sharp corner or edge. Furthermore, the contraction 22 makes it more difficult for the electric arc to move from the contact plate 11 onto the base 14.

The blow magnets 23 produce a magnetic field which is applied in the region of the contacts 3 perpendicularly relative to the contact direction K in which the bridging element 10 is applied to the contacts, and extends perpendicularly relative to the connection line between the two contacts 3. The electric arc which occurs when the electrical connection is separated is moved in a selective manner by the magnetic field away from the contact piece 12 in an inward or an outward direction. In this instance, it increases and ultimately separates.

The magnetic field created by the blow magnets 23 forms a magnetic circuit which is directed through the contact switch chamber 2. Owing to the coupling via the flux-conducting metal sheets 24, 25, the magnetic field M within the contact switch chamber 2, in particular in the region of the contacts 3, is particularly strong and the extinguishing effect of the magnetic field M is particularly good.

Figure 6:
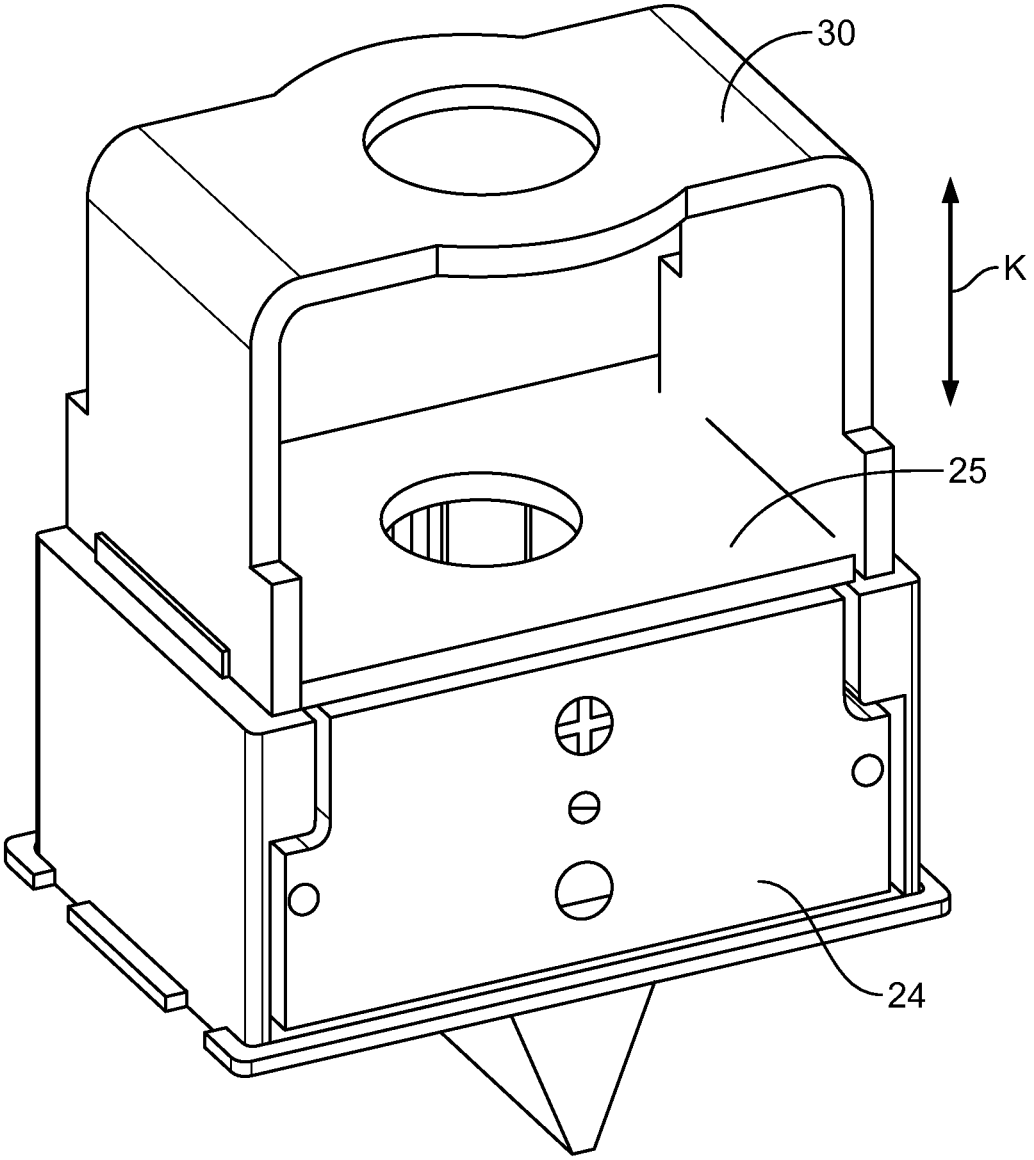
FIG. 6 is a perspective view of an electrical switch element according to the invention.
Figure 7:
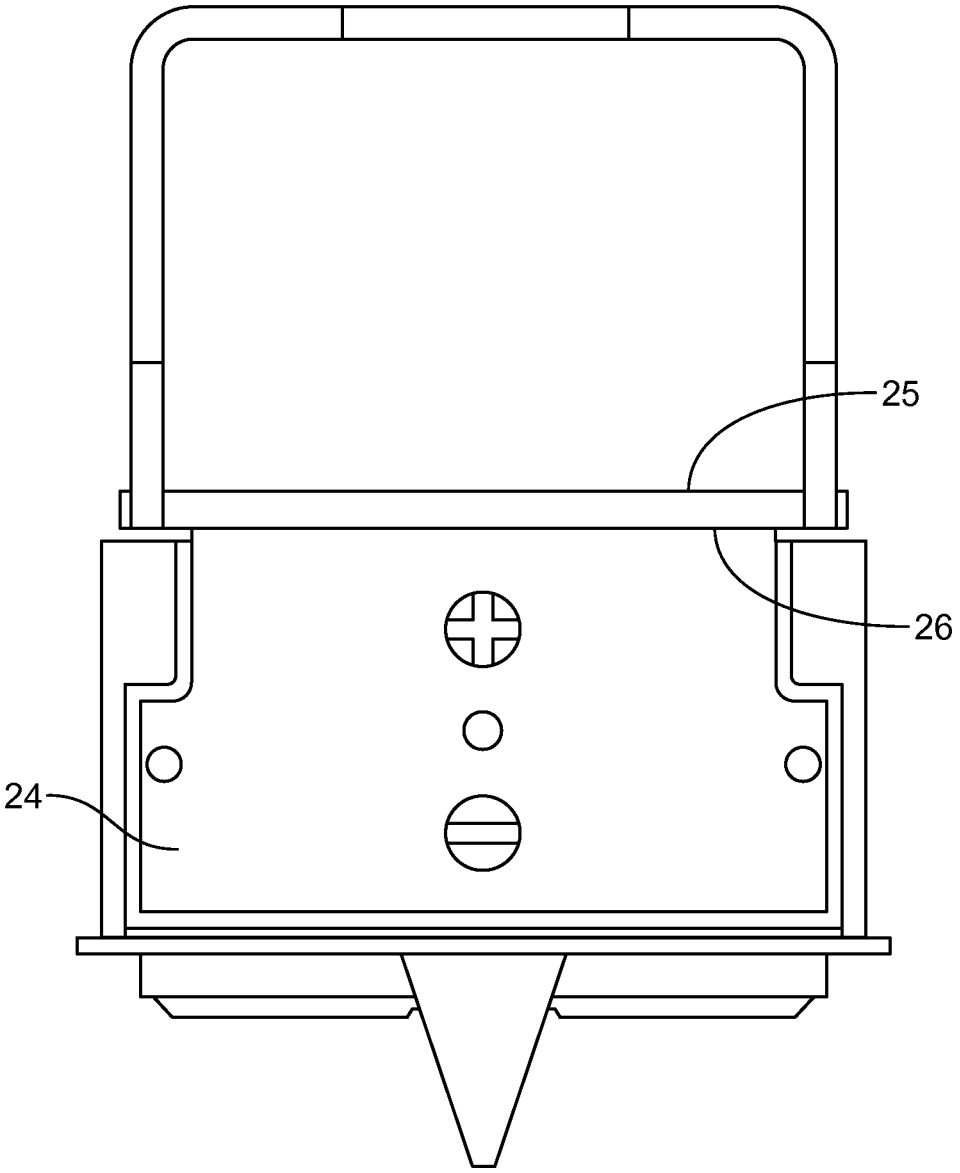
FIG. 7 is a side view of the electrical switch element of FIG. 6.

FIGS. 6 and 7 show an additional embodiment of the electric switch element 1 further including a yoke 30, for example, for an electromagnetic linear drive (not shown), which moves the bridging element in the contact direction K. It can further be seen that the upper flux-conducting metal sheet 25 is connected to the yoke 30 and is thereby located in the magnetic circuit of the electromagnetic linear drive for the bridging element 10. The flux-conducting metal sheet 25 is thus required for the magnetic circuit of the electromagnetic linear drive and is additionally used for the magnetic field M of the blow magnets. This embodiment is particularly space-saving since the blow magnet circuit uses the iron components of the drive system which are already present. Furthermore, the lateral flux-conducting metal sheets 24 may thereby be constructed so as to be planar.

In FIG. 7, it can be seen that the upper flux-conducting metal sheet 25 is positioned with a small gap relative to a horizontal upper edge 26 of the flux-conducting metal sheet 24. However, the flux-conducting metal sheet may also be in abutment with the horizontal upper edge 26 of the flux-conducting metal sheet 24.

What is claimed is:

1. An electrical contact switch chamber, comprising:

two contacts;

a wall having a base, a plurality of sides surrounding the two contacts, and a collection trough extending transversely between the two contacts; and at least one insulation slot at least partially having a substantially U-shaped cross-section and having an opening extending transversely relative to a direction between the contacts and continuously from a first side, along the base, and to an opposite second side into portions of the base and the sides between the two contacts, the insulation slot at least partially expanding behind the opening which forms a tapered neck portion and having a portion extending parallel to the direction between the contacts.

2. The electrical contact switch chamber of claim 1, wherein the collection trough is disposed between a contact and an insulation slot.

3. The electrical contact switch chamber of claim 2, wherein an inner wall of the collection trough extends around a contact at a side closer to the contact.

4. The electrical contact switch chamber of claim 3, wherein an edge of the collection trough has a chamfer at a side closer to a contact.

5. The electrical contact switch chamber of claim 1, wherein a partition wall protruding from the base forms two part-chambers.

6. The electrical contact switch chamber of claim 5, wherein the partition wall does not extend as far from the base as the sides.

7. The electrical contact switch chamber of claim 6, wherein each part-chamber contains a contact.

8. The electrical contact switch chamber of claim 7, wherein each part-chamber has an insulation slot.

9. The electrical contact switch chamber of claim 8, wherein the insulation slots are separated from each other by the partition wall.

10. The electrical contact switch chamber of claim 1, wherein each of the contacts has a contact plate and a base wider than the contact plate.

11. The electrical contact switch chamber of claim 10, wherein each of the contacts further has a contraction disposed between the contact plate and the base, the contraction narrower than both the contact plate and the base.

12. The electrical contact switch chamber of claim 1, further comprising two blow magnets opposite a contact and flex-conducting metal sheets connecting the blow magnets in a magnetically conductive manner.

13. The electrical contact switch chamber of claim 12, further comprising a yoke of an electromagnetic linear drive, the yoke connected to a flux-conducting metal sheet in a magnetically conductive manner.

14. An electrical contact switch element, comprising:

an electrical contact switch chamber including two contacts, a wall having a base, a plurality of sides surrounding the two contacts, and a collection trough extending transversely between the two contacts, and at least one insulation slot at least partially having a substantially U-shaped cross-section and having an opening extending transversely relative to a direction between the contacts and continuously from a first side, along the base, and to an opposite second side into portions of the base and the sides between the two contacts, the insulation slot at least partially expanding behind the opening which forms a tapered neck portion and having a portion extending parallel to the direction between the contacts; and a bridging element having two contact counter-pieces.

* * * * *